US008187445B2

(12) United States Patent
Boutigny et al.

(10) Patent No.: US 8,187,445 B2
(45) Date of Patent: May 29, 2012

(54) PROCESS FOR MANUFACTURING A THICK PLATE ELECTROFORMED MONOBLOC MICROWAVE SOURCE

(75) Inventors: Pierre-Henri Boutigny, Melun (FR); Pascal Boivin, Viroflay (FR); Alain Lefevre, Laval (FR)

(73) Assignee: Thales, Neuilly sur Seine (FR)

( * ) Notice: Subject to any disclaimer, the term of this patent is extended or adjusted under 35 U.S.C. 154(b) by 850 days.

(21) Appl. No.: 12/268,147

(22) Filed: Nov. 10, 2008

(65) Prior Publication Data

US 2009/0250640 A1 Oct. 8, 2009

(30) Foreign Application Priority Data

Nov. 9, 2007 (FR) ..... 07 07856

(51) Int. Cl.
*C25D 1/00* (2006.01)

(52) U.S. Cl. ..... 205/78

(58) Field of Classification Search ..... 205/78
See application file for complete search history.

(56) References Cited

U.S. PATENT DOCUMENTS

| | | | | |
|---|---|---|---|---|
| 3,982,213 | A * | 9/1976 | Smith et al. | 333/158 |
| 4,122,406 | A * | 10/1978 | Salzberg | 333/113 |
| 4,373,306 | A * | 2/1983 | Rech | 52/98 |
| 4,620,163 | A * | 10/1986 | Young | 333/21 R |
| 5,305,001 | A | 4/1994 | Wong et al. | |
| 5,398,010 | A * | 3/1995 | Klebe | 333/239 |
| 6,816,042 | B1 * | 11/2004 | Noyes et al. | 333/248 |
| 6,861,997 | B2 | 3/2005 | Mahon | |
| 7,034,774 | B2 * | 4/2006 | Kuo et al. | 343/909 |
| 7,132,907 | B2 * | 11/2006 | Chambelin et al. | 333/135 |
| 2006/0279373 | A1 * | 12/2006 | Keating et al. | 333/24.3 |

* cited by examiner

*Primary Examiner* — Luan Van
(74) *Attorney, Agent, or Firm* — Stroock & Stroock & Lavan LLP

(57) ABSTRACT

Microwave source and polarizer which is formed of an electroformed monobloc comprising a thick plate or septum, greater than 1 mm in thickness. Frequencies of application include the 7.25 GHz and 8.4 GHz frequency bands.

5 Claims, 3 Drawing Sheets

PROCESS FOR MANUFACTURING A THICK PLATE ELECTROFORMED MONOBLOC MICROWAVE SOURCE

This application under 35 U.S.C. §119 claims priority from French patent application No. 0707856 filed with the French Patent Office on Nov. 9, 2007, which is incorporated herein by reference in its entirety.

FIELD OF THE INVENTION

The present invention relates to a process for manufacturing a monobloc microwave source by electroforming a thick plate polarizer better known as a thick septum.

It finds its application within the field using microwave source/antenna assemblies. It can be implemented for communication satellite applications.

BACKGROUND OF THE INVENTION

Space telecommunication antennas, with circular polarization, often use waveguide structures when a severe polarization purity criterion is specified. Among them, the polarization system with four quadrature-fed ports, the Septum-type polarizer and the orthomode tee coupled to a screw polarizer remain the most used. However the size and mass of these systems hamper their use in certain applications and in particular in the low bands of telecommunication frequencies (L, S, C bands).

Intermodulation at the antenna level is a problem that has been known to constructors of communication satellites for many years. This problem also exists in the case of GSM antennas (the abbreviation standing for Global System for Mobile).

In the case of terrestrial satellite stations, the use of certain bands in multicarrier mode requires the solution of technical problems related to the metallic contacts appearing when making the antenna and source. Among the technical problems are adjustments by screws/plungers, interfaces of flange type, add-on parts. It is known from the prior art that one of the better approaches is to make a minimum of parts and to use electroforming technology for the construction of the microwave sources. One of the constraints to be complied with is then that the electrical design of the microwave source be adapted to enable it to be made in this particular process.

Another drawback encountered in the field of microwave structures is that they lead to relatively significant sizes of device. Thus, a solution given in the patent is to manufacture an assembly formed of an antenna and of an assembly of horns.

U.S. Pat. No. 6,861,997 describes a polarizer intended to be used in antennas associated with waveguides. The idea implemented in this patent consists in using two waveguides having a common wall. The form of the central wall consists of several teeth whose form and dimensions enable the septum to transform the linear polarization of a wave into a circular polarization and vice versa.

Nevertheless, the prior art devices generally consist in linking 2 rectangular guides to form a single guide with square cross section by way of a plate generally cut stepwise. This process works well if the plate is very slender, such as for example in U.S. Pat. No. 5,305,001, for which the plate has a thickness of the order of 0.76 mm.

FIG. 1 represents a schematic of a satellite communication station with X band circular polarization. The emission signal passes through an emission amplifier 1, then into an emission filter 2 before the polarizing orthomode 3 whose function is to transform the initial polarization, for example a linear polarization, into a circular polarization, and is then emitted by way of the horn 4 of the reflector-type antenna. The signal is thereafter received by the antenna before passing through the polarizing orthomode 3, then a reception filter 5 and a low noise amplifier 6. Practice shows that filtering is necessary but not sufficient to eliminate the intermodulation problems encountered with microwaves. Specifically, other non-linearities are present along the chain.

They originate notably from all the contacts between metals introduced by assembling the source to the focus of the antenna. These contacts are, for example, the flanges of the joining guides, the screw plungers for adjusting the filters.

When the frequency plan used in a satellite communication system comprises very close reception and emission frequencies, for example the interval 7.25-7.75 GHz for reception and the interval 7.9-8.4 GHz in emission, for example when a station emits several carriers (from 2 carriers, for example), additional frequencies may be generated. For frequencies lying between 8.0 GHz and 8.4 GHz, any non-linearity of the transmission system will create additional frequencies, the most powerful of which are 7.6 and 8.8 GHz. The 7.6 GHz frequency is located in the reception band, and this will end up being particularly demanding on the quality of linearity of the system so as not to generate self-jamming.

The software known to the person skilled in the art, for example the software having the trademark MICIAN for microwavewizard, makes it possible to synthesize and to simulate various structures.

To the Applicant's knowledge, the performance levels obtained by the devices according to the prior art nevertheless do not make it possible to maintain the desired performance levels while increasing the thickness of the plate beyond 2 mm.

SUMMARY OF THE INVENTION

The idea of the invention relies on a new approach which consists in achieving all the microwave functions in the form of a single part. The microwave source is made in one piece. In fact, the non-linearity phenomena are non-existent or negligible.

Embodiments of the invention relate to a microwave source and polarizer which is formed of an electroformed monobloc comprising a thick plate or septum, greater than 1 mm in thickness.

The source comprises at least the following elements: a horn, an orthomode/polarizer, an emission bandpass filter, an emission bandstop filter, a reception bandpass filter, a reception bandstop filter.

The plate or septum comprises, for example, a number of steps and a widening D at the level of the access guides, said widening being disposed in an intermediate position along the plate.

Embodiments of the invention also relate to a process for manufacturing a microwave source with thick plate polarizer which comprises at least the following stages:

- using an electroforming process,
- fixing the dimension C of the output guide so that only a chosen fundamental mode of the guide of the dimension C is in the useful bandwidth of the microwave source,
- fixing the dimension A corresponding substantially to half the width of the waveguide taken in its widened portion by means of a setback D and B the height of the waveguide so that the guide of cross section (2*A+H, B) propagates only the fundamental mode in the bandwidth, fixing an arbitrary dimension for the setback D, determining the height and/or the length of the steps of the thick plate, so as to obtain performance levels of the microwave source that are fixed by a given application, modifying the dimension D and repeating the previous stages so as to optimize the result of the performance.

The mode used is for example the TE10 mode.

The chosen frequency band is the 7.25 GHz and 8.4 GHz frequency band.

BRIEF DESCRIPTION OF THE DRAWINGS

Other characteristics and advantages of the present invention will be more apparent on reading the description of an exemplary embodiment given by way of wholly non-limiting illustration together with the figures which represent.

DETAILED DESCRIPTION

Figure 1:
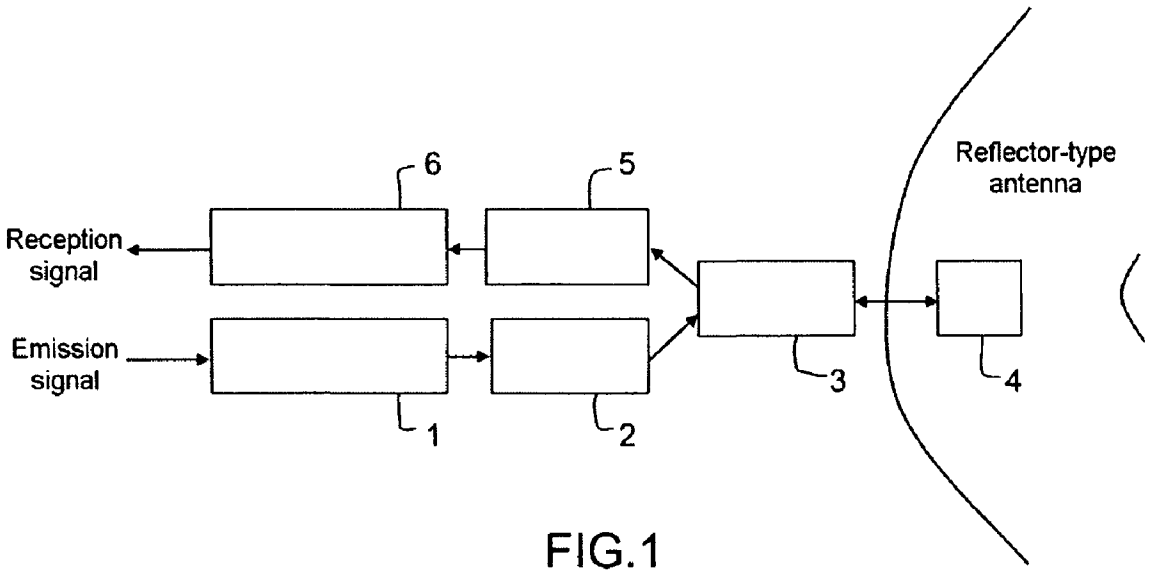
FIG. 1, a schematic of a satellite communication station with circular polarization, FIG. 2, a diagram briefly recalling the process by electroforming, FIG. 3, an exemplary plate or septum according to the prior art, FIG. 4, a diagram of a monobloc source according to the invention, FIG. 5, a detail of the thick plate polarizer according to the invention.
Figure 2:
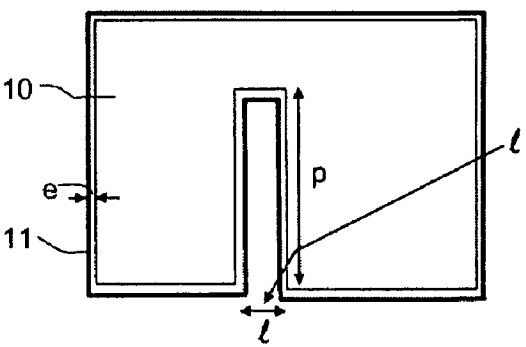

FIG. 2 is a reminder regarding the electroforming process. This process consists in depositing a metal, for example copper, by electrolysis on an aluminum mandrel. On completion of this deposition, the mandrel is dissolved and a hollow copper part of "waveguide" type is obtained. Certain characteristics of the process require compliance with geometric rules, such as, the ratio of the width of a hollow to its depth. In FIG. 2, the part 10 is an aluminum part on which a copper deposition 11 of thickness e is carried out. The minimum width l of the hollow is imposed according to the depth p.

Figure 3:
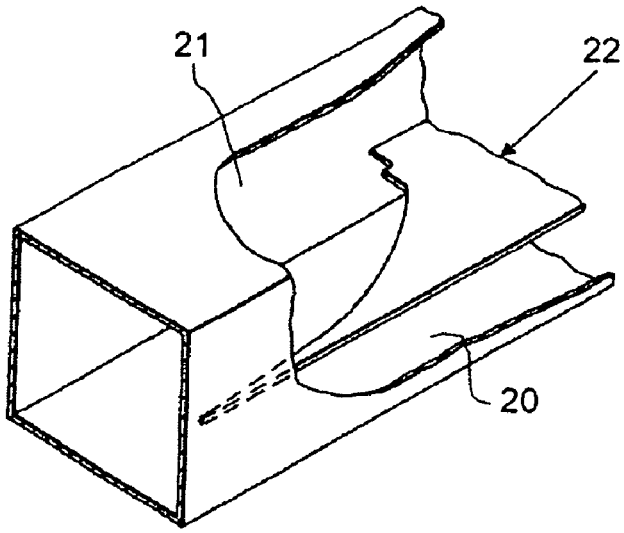

FIG. 3 recalls the very thin plate described in U.S. Pat. No. 5,305,001 in which the source is formed of two rectangular cavities 20, 21 and of a very thin plate 22 or "septum" whose thickness is of the order of 0.7 mm.

Figure 4:
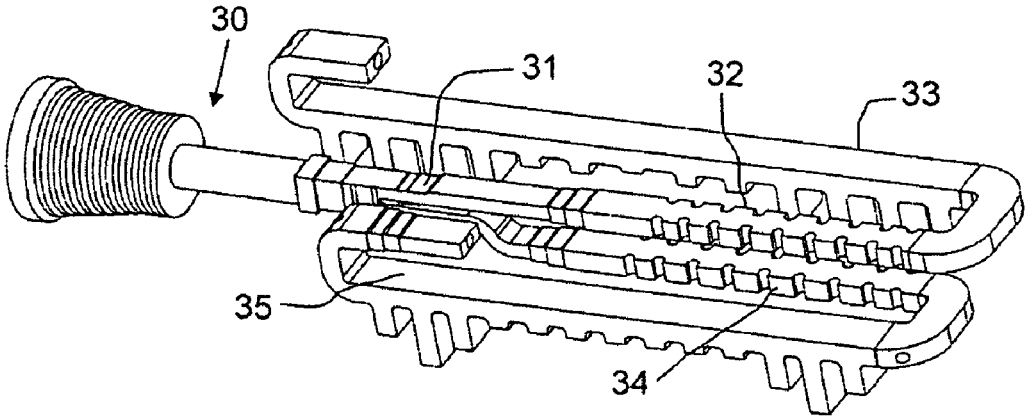

FIG. 4 represents a monobloc X band source according to the invention, the size of the object being approximately 1 m. The monobloc source comprises the following functions:

horn 30 orthomode/polarizer 31 emission bandpass filter 32 emission bandstop filter 33 reception bandpass filter 34 reception bandstop filter 35.

Figure 5:
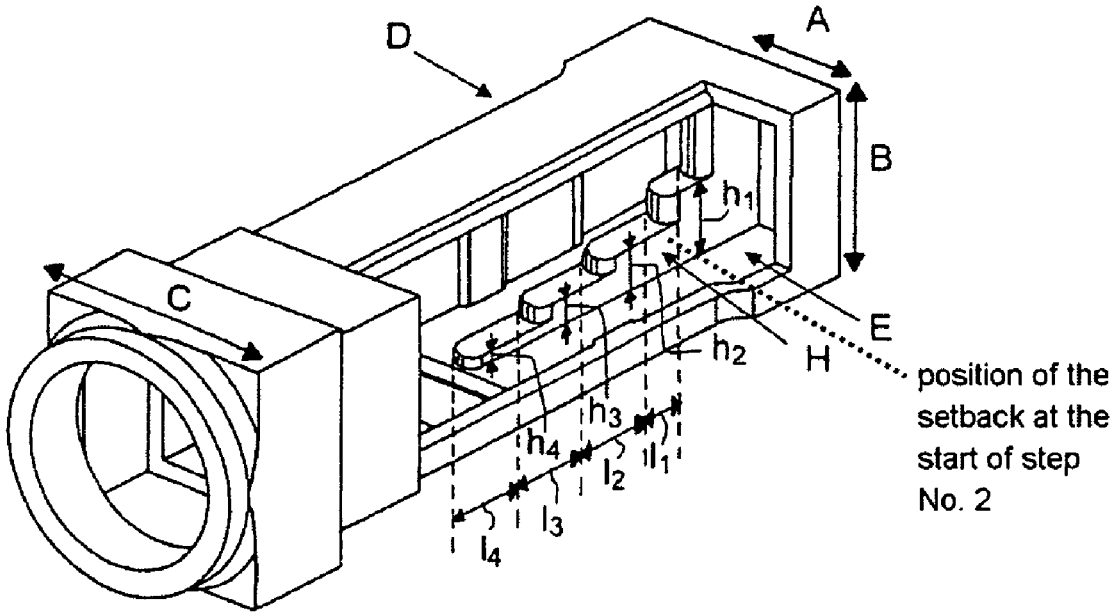

The assembly of the monobloc structure according to the invention is designed in such a way that there are no sharp corners of small size, but also that the steps of the plate are rounded as is represented in FIG. 5. This makes it possible to avoid these sharp corners of small size which are poorly reproduced by the electroforming process notably on this part whose geometry must be very accurate.

The process according to the invention comprises for example the following stages:

A widening of the access guides is created in an intermediate position along the plate, represented by the setback D in FIG. 5. The function of this widening or setback is notably to compensate for the thickness of the thick plate finally obtained. The thick plate or septum is at least 1 mm for example. According to an exemplary embodiment, by referencing the various dimensions with respect to the wavelength used, the polarizing orthomode according to the invention exhibits for example the following characteristics:

| | | | |
|---|---|---|---|
| A | ~λ4 | 11.5 | mm |
| B | ~λ/2 | 23.5 | |
| C | ~3λ/4 | 32 | mm |
| H | dimension of the plate or septum | 5 | mm |
| D | (2A + H − B)/2 | 2.25 | mm |
| l1 | ~λ/6 | 8 | mm (rounded) |
| l2 | ~λ/3 | 15 | mm (rounded) |
| l3 | ~λ/3 | 15 | mm (rounded) |
| l4 | ~λ/3 | 15 | mm (rounded) |
| h1 | ~λ/4 | 12 | mm (rounded) |
| h2 | ~h1/2 | 6 | mm (rounded) |
| h3 | ~h2/2 | 3 | mm (rounded) |
| h4 | ~h3/2 | 1.5 | mm (rounded) |

With A corresponding to half the width of the waveguide taken in its widened portion, B the height of the waveguide, C the width of the waveguide on input output of the wave, H the width of the plate, D the setback chosen to compensate for the thickness of the plate, l1, l2, l3, l4 the length of the 4 steps of the thick plate, h1, h2, h3, h4 the corresponding height of the 4 steps, the height being measured with respect to a reference corresponding to the internal wall of the waveguide in contact with the steps.

On the basis of data fixed at the outset, the process thereafter comprises the following stages:

Fixing the dimension C of the output guide so that only the TE10 fundamental mode of the guide of dimension C is in the useful bandwidth of the microwave source, for example in the X band (7.25-8.4 GHz), Fixing the dimensions A and B so that the guide of cross section (2*A+H, B) propagates only the TE10 fundamental mode in the bandwidth of the microwave source, Fixing an arbitrary dimension D, Optimizing the height and the length of the steps of the plate to obtain the desired performance levels which depend on the application and are, for example: the SWR of each input, the isolation between input 1 and input 2, the axial ratio of the wave at the output of C and for each input 1 or 2, Modifying the dimension D and repeating the aforesaid stages.

By following these stages, the process according to the invention makes it possible to obtain an electroformed monobloc microwave source with thick plate polarizer.

As electrical performance is related to the absence of discontinuities (separation or zones of contact between different metals) over the whole surface of the sources, the process for making the mandrel is chosen in such a way that:

a) The microwave source to be made is broken down into various elements.

b) Each element is made as a negative (a hollow waveguide becomes a solid part) in a defined type of aluminum by a mechanical process which can be either machining or wire cutting. These elements are called mandrels.

c) The various mandrels are assembled by a tenon and mortise process so that all the metallic interconnection portions are in tight contact so as to guarantee good electrical continuity of the mechanical assembly, which continuity is necessary for the electroforming process.

d) By electrolysis, a copper deposition about 3 mm in thickness is created on this assemblage.

e) All the aluminum mandrels are finally dissolved in an alkaline solution, the copper portion being inert in relation to this solution.

f) The copper monobloc microwave source is thus obtained after cleaning of the residual copper oxides.

The invention claimed is:

1. A process for manufacturing a monobloc microwave source with a polarizer, the microwave source operating in a frequency band of 7.25 GHz to 8.4 GHz, the polarizer comprising a thick plate and a waveguide, the process comprising the following steps:

electroforming the monobloc microwave source and the polarizer, wherein the thick plate has a thickness of at least 1 mm and comprises four steps of length l1, l2, l3 and l4 and of height h1, h2, h3 and h4 respectively, the thick plate having a width H and a setback D chosen to compensate for the thickness of the thick plate, said waveguide having a dimension C corresponding to an output of the waveguide, a dimension A corresponding substantially to half the width of the waveguide taken in its widened portion, a dimension B corresponding to the height of said waveguide;

fixing the dimension C of the output so that only a chosen fundamental mode of the output is in the useful bandwidth of the microwave source;

selecting a predetermined dimension for the setback D; and iterating the following steps until a predetermined performance level of the microwave source is achieved:

selecting the dimension A by means of the setback D and the height B of the waveguide so that the guide of cross section (2*A+H, B) propagates only the fundamental mode in the bandwidth;

determining the height or the length of the steps of the thick plate, so as to obtain performance levels of the microwave source that are fixed by a given application; and modifying the setback D and repeating the steps of selecting the dimension A and determining the height or the length until the predetermined performance level is achieved.

2. The process as claimed in claim 1, wherein the step of electroforming comprises the following steps:

preparing a mandrel of each element of the microwave source, wherein the mandrel is a negative of the corresponding element;

assembling the mandrels by a tenon and mortise process to create a mechanical assembly, so that the metallic interconnection portions are in tight contact so as to achieve good electrical continuity of the mechanical assembly;

depositing by electrolysis a copper deposition substantially in the range of 3 mm in thickness on the mechanical assembly;

dissolving the aluminum mandrels in an alkaline solution, the copper deposition being inert in relation to the alkaline solution so as to obtain the copper monobloc microwave source.

3. The process as claimed in claim 1, wherein the fundamental mode is the TE10 mode.

4. The process as claimed in claim 1, wherein a chosen frequency band of the waveguide is the 7.25 GHz receiving frequency band and the 8.4 GHz emitting frequency band.

5. The process as claimed in claim 2, wherein a chosen frequency band of the waveguide is the 7.25 GHz receiving frequency band and the 8.4 GHz emitting frequency band.

* * * * *